US009166328B2

(12) United States Patent
Eckel et al.

(10) Patent No.: US 9,166,328 B2
(45) Date of Patent: Oct. 20, 2015

(54) CONNECTOR, IN PARTICULAR AN ELECTRICAL CONNECTOR

(71) Applicant: Tyco Electronics AMP GmbH, Bensheim (DE)

(72) Inventors: Markus Eckel, Buerstadt (DE); Frank Wittrock, Schriesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 14/141,959

(22) Filed: Dec. 27, 2013

(65) Prior Publication Data

US 2014/0113474 A1 Apr. 24, 2014

Related U.S. Application Data

(63) Continuation of application No. PCT/EP2012/062008, filed on Jun. 21, 2012.

(30) Foreign Application Priority Data

Jun. 29, 2011 (DE) ..... 10 2011 078 284

(51) Int. Cl.
*H01R 13/52* (2006.01)
*H01R 13/506* (2006.01)
*H01R 13/58* (2006.01)

(52) U.S. Cl.
CPC ..... *H01R 13/5202* (2013.01); *H01R 13/506* (2013.01); *H01R 13/5221* (2013.01); *H01R 13/5205* (2013.01); *H01R 13/5825* (2013.01); *H01R 2201/26* (2013.01)

(58) Field of Classification Search
CPC ..... H01R 13/5219; H01R 13/5202; H01R 13/52; H01R 13/521; H01R 13/5208
See application file for complete search history.

(56) References Cited

U.S. PATENT DOCUMENTS

| | | | | |
|---|---|---|---|---|
| 5,197,898 | A | 3/1993 | Nagamine | |
| 5,252,092 | A | 10/1993 | Reider et al. | |
| 5,571,032 | A | 11/1996 | Sano et al. | |
| 2007/0049111 | A1 | 3/2007 | Muller et al. | |
| 2009/0035976 | A1* | 2/2009 | Matsunaga | 439/271 |
| 2010/0055954 | A1* | 3/2010 | Martin et al. | 439/278 |
| 2010/0151721 | A1 | 6/2010 | Tyler | |
| 2011/0287648 | A1* | 11/2011 | Uchida | 439/271 |
| 2014/0213088 | A1* | 7/2014 | Furuya et al. | 439/271 |

OTHER PUBLICATIONS

PCT International Preliminary Report on Patentability and PCT Written Opinion of the International Searching Authority, International Application No. PCT/EP2012/062008, dated Jan. 7, 2014, 12 pages.

PCT Notification Concerning Transmittal of International Preliminary Report on Patentability, International Application No. PCT/EP2012/062008, dated Jan. 16, 2014, 1 page.

(Continued)

*Primary Examiner* — Gary Paumen
(74) *Attorney, Agent, or Firm* — Barley Snyder

(57) ABSTRACT

A connector is provided having an outer housing, an inner housing and a seal. The seal includes a first sealing device that positioned between the outer housing and the inner housing such that a mating connector receiving gap is provided between an inner side of the outer housing and the first sealing device.

12 Claims, 4 Drawing Sheets

(56) References Cited

OTHER PUBLICATIONS

PCT Notification of Transmittal of the International Search Report and the Written Opinion of the International Searching Authority, International Search Report and Written Opinion, International Application No. PCT/EP2012/062008, dated Aug. 17, 2012, 16 pages.
Chinese Office Action, dated Jul. 14, 2015, 7 pages.
English Translation of Chinese Office Action, dated Jul. 14, 2015, 10 pages.

* cited by examiner

CONNECTOR, IN PARTICULAR AN ELECTRICAL CONNECTOR

CROSS-REFERENCE TO RELATED APPLICATIONS

This application is a continuation of PCT International Application No. PCT/EP2012/062008 filed Jun. 21, 2012, which claims priority under 35 U.S.C. §119 to German Patent Application No. 102011078284.2 filed Jun. 29, 2011.

FIELD OF INVENTION

The invention relates to a connector and, in particular, to a plug type connector having an outer housing, a seal, and an inner housing.

BACKGROUND

In electrical engineering and electronics, there are known a large number of electrical socket and/or pin or stud connectors, referred to below as electrical (plug type) connectors, counter-(plug type) connectors or (counter-) connection devices, which serve to transmit electrical voltages, currents and/or signals with the greatest possible range of currents, voltages, frequencies and/or data rates. In particular, in the automotive sector, such connectors must temporarily or permanently ensure correct transmission of electrical power, signals and/or data under dirty, damp and/or chemically aggressive conditions. Owing to a large range of applications for such connectors, a large number of specially constructed socket and/or pin connectors are known.

Such known electrical connectors or the connector housings thereof may be assembled on an electrical line, a cable, a cable harness or an electrical device, such as, for example, on/in a housing or on a printed-circuit board of an electrical or electronic device. For the former, the component is usually referred to as a (counter-)connection device. If a connector is located on a line or a cable, it is usually referred to as a floating (plug type) connector, a plug or a coupling; if it is located on/in an electrical/electronic device, it is usually referred to as a flush type plug or a (flush type) socket. Furthermore, a mating connector is often also referred to as a plug receiving member, particularly when the mating connector has a support collar which is intended to ensure a more robust connection between a plug type connector and the mating connector, that is to say, the plug receiving member.

Transmission of data is nowadays becoming increasingly significant, high demands with regard to the data transmission being a decisive factor in almost every industrial sector, such as, for example, the computer or the automotive industry. In this instance, in addition to electrical connectors, wide product ranges of optical and electro-optical connectors which ensure high rates of data transmission are required. For instance, in a motor vehicle, for example, entertainment and infotainment data are exchanged not only electrically but also via an optical bus. For these and also other electrical and/or optical data transmission technologies, connectors and connection devices are required which electrically and/or optically couple or connect together the electrical, electro-optical and/or optical components.

Furthermore, for example, for electrical charging stations, connectors or couplings are required which supply electrical current to batteries for various applications. Thus, there are required, for example, electrical connectors for supply units such as, for example, a wall box in a garage, on a carport or on a wall region or electrical charging stations for electric and/or hybrid vehicles, by means of which the batteries of the motor vehicle can be charged with electrical power. To this end, the electrical connector must again permanently and reliably prevent the introduction of moisture and dirt and ensure problem-free transmission of the electrical charging current and other electrical or electronic signals for controlling the charging operation of the battery(ies).

U.S. Pat. No. 5,571,032 discloses a sealed electrical plug type connector for electronic control of an automatic gear mechanism of a motor vehicle. A two-piece housing of the plug type connector includes an outer hosing which may engage an inner housing that acts as a retention member for electrical contact devices. When the inner housing is assembled in the outer housing, the inner housing which is provided with the contact devices is moved forward from one side through an opening of the outer housing, into the housing and engaged therein. The contact devices of an electrical line become arranged in the plug type connector. Remote from an insertion face, the plug type connector and the individual wires of the line are sealed with respect to the environment by means of a rubber seal. A connection of the plug type connector with a mating connector must additionally be sealed.

SUMMARY

An object of the invention, among others, is to provide an improved connector for applications in the automotive or electrical engineering sector.

The connector includes an outer housing, an inner housing and a seal. The seal includes a first sealing device that positioned between the outer housing and the inner housing such that a mating connector receiving gap is provided between an inner side of the outer housing and the first sealing device.

BRIEF DESCRIPTION OF THE DRAWINGS

The invention is explained in greater detail below with reference to embodiments and the appended drawings. In the detailed Figures of the drawings.

DETAILED DESCRIPTION OF THE EMBODIMENT(S)

The invention is explained in greater detail below with reference to the drawings.

Figure 1:
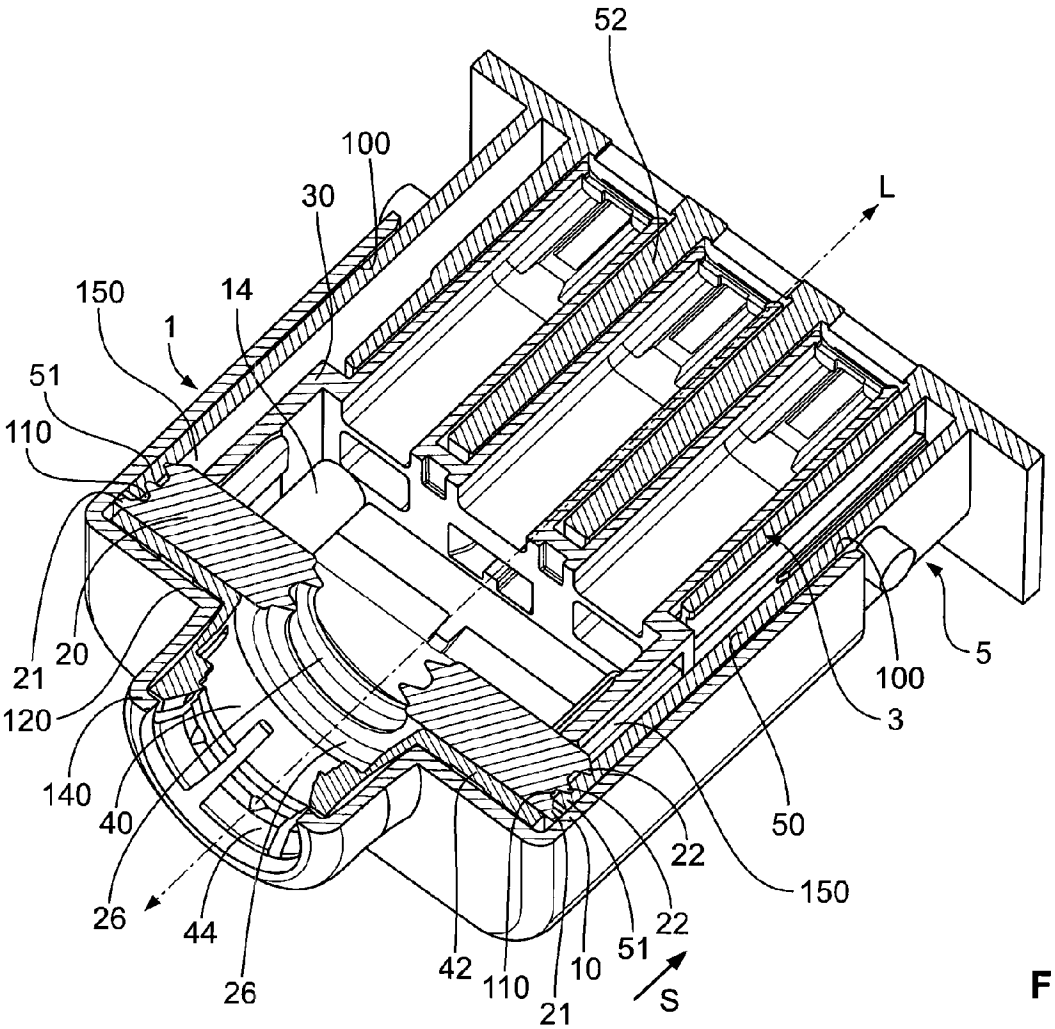
FIG. 1 is a perspective sectional view of a connector according to the invention.
Figure 2:
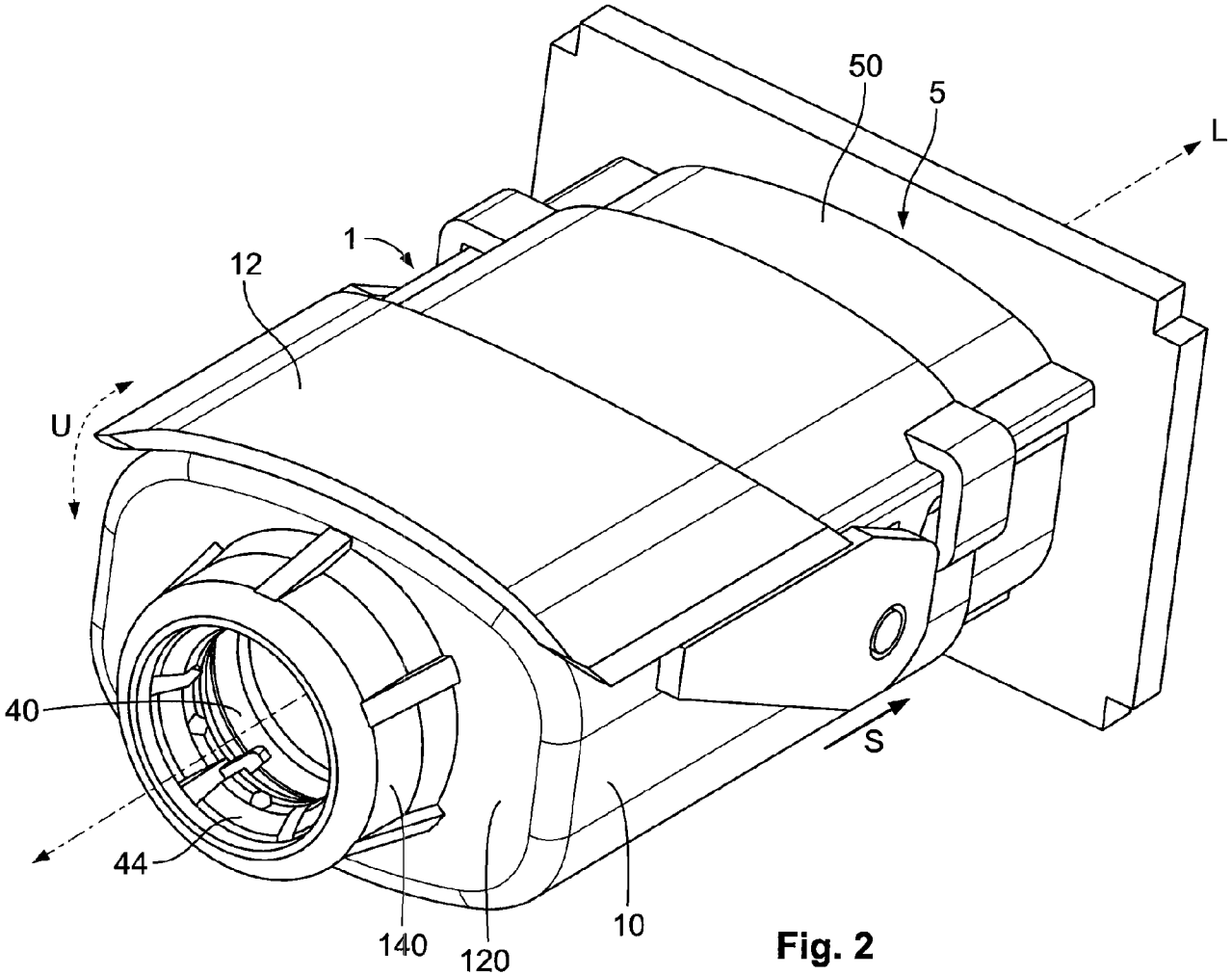
FIG. 2 is a perspective view a connector according to the invention.
Figure 3:
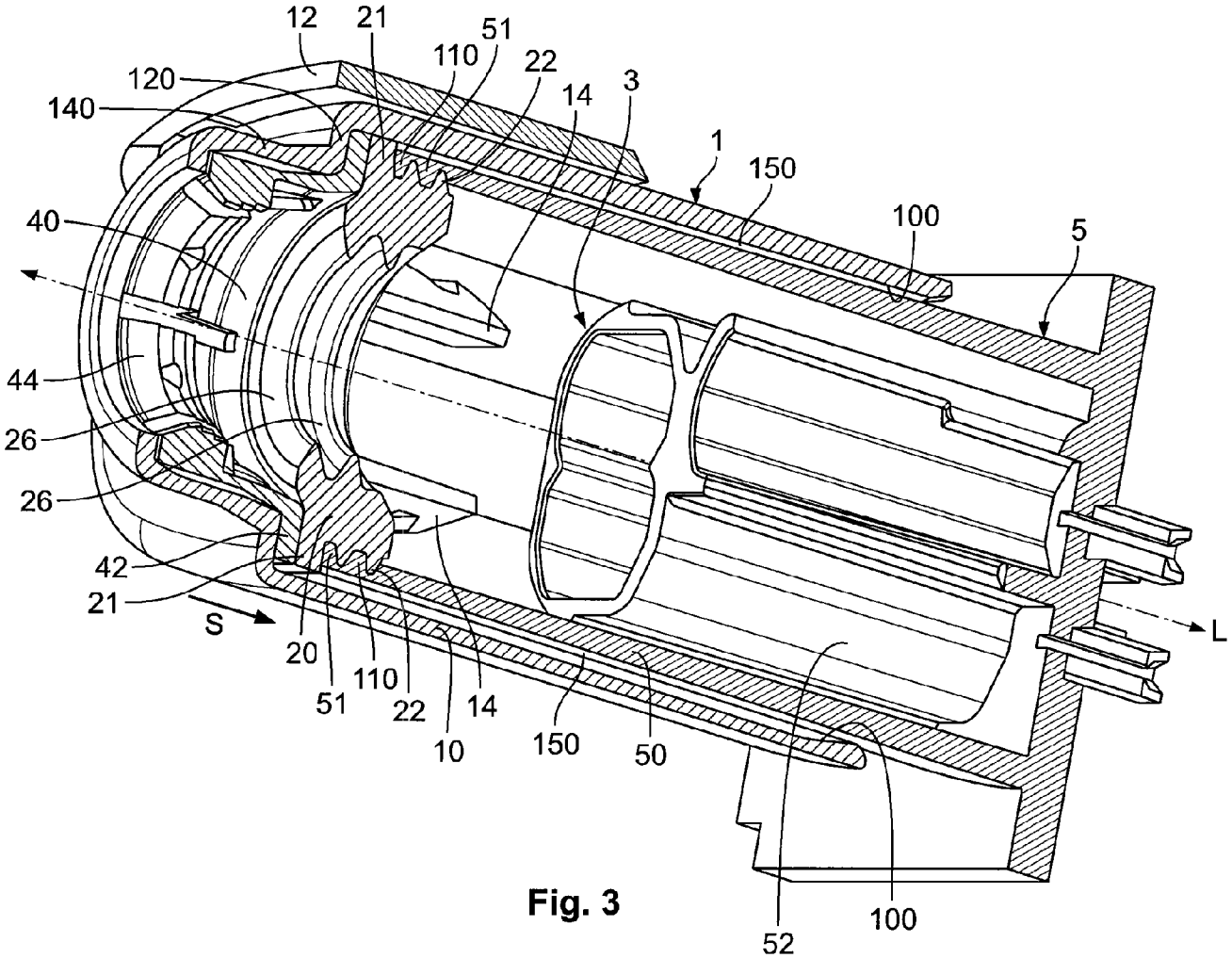
FIG. 3 is a perspective sectional view of the connector of FIG. 2.

As shown in FIGS. 1-3, a connector 1 according to the invention is shown and may be used for plug type connections in the automotive sector. The connector 1 may be constructed as a high-voltage plug type connector of a charging socket coupling for a charging station. However, the invention is not intended to be limited to electrical plug type connectors, but instead can be used on all connectors, plug type connectors or connection devices for electrical, optical and/or electro-optical connections. In this instance, the term connector 1 is intended to include the terms plug type connector and connection device. The connector 1 may be constructed as a socket, pin or hybrid connector and may be a (floating) coupling, a (flush type) plug, a (flush type) socket, a socket and/or plug receiving member, a header, an interface, etc. The same is intended to apply to a mating connector 5, which complements the connector 1 or which corresponds thereto.

FIGS. 1 to 3 illustrate alternative, slightly differing embodiments of plug connections, the connector 1 being shown on the mating connector 5 after insertion thereof, respectively. In this instance, the connector 1 is placed on the mating connector 5, an outer housing 10 of the connector 1 constructed as a cap receiving at the inner side a mating connector housing 50 which is constructed as a trough. The term housing is also intended to include the terms integral component, component, region and/or portion of a housing which may optionally be assembled. Between the two housings 10, 50, an electrical, optical and/or electro-optical contact region 3 is formed, an inner housing 30 of the connector 1 that is constructed as a contact housing producing the corresponding contacts with a contact housing 52 of the mating connector 5. In this instance, the contact housing 52 of the mating connector 5 may be an integral component of the mating connector housing 50.

The inner housing 30 is constructed in such a manner and arranged in such a manner with respect to and in the outer housing 10 of the connector 1 that a gap 150 remains between the outer housing 10 and the inner housing 30 in a peripheral direction U (see FIG. 2, cf. FIG. 4) of the connector 1 for receiving an outer peripheral portion of the mating connector housing 50. In this instance, the inner housing 30 is centrally positioned in the outer housing 10 and securely connected thereto. A single seal 20 is positioned between an inner longitudinal end of the inner housing 30 and an inner shoulder 120 of the outer housing 10. The single seal 20 is constructed as a combination seal (see also FIG. 4) and which substantially completely seals the connector 1 with respect to connection with the mating connector 5.

Figure 4:
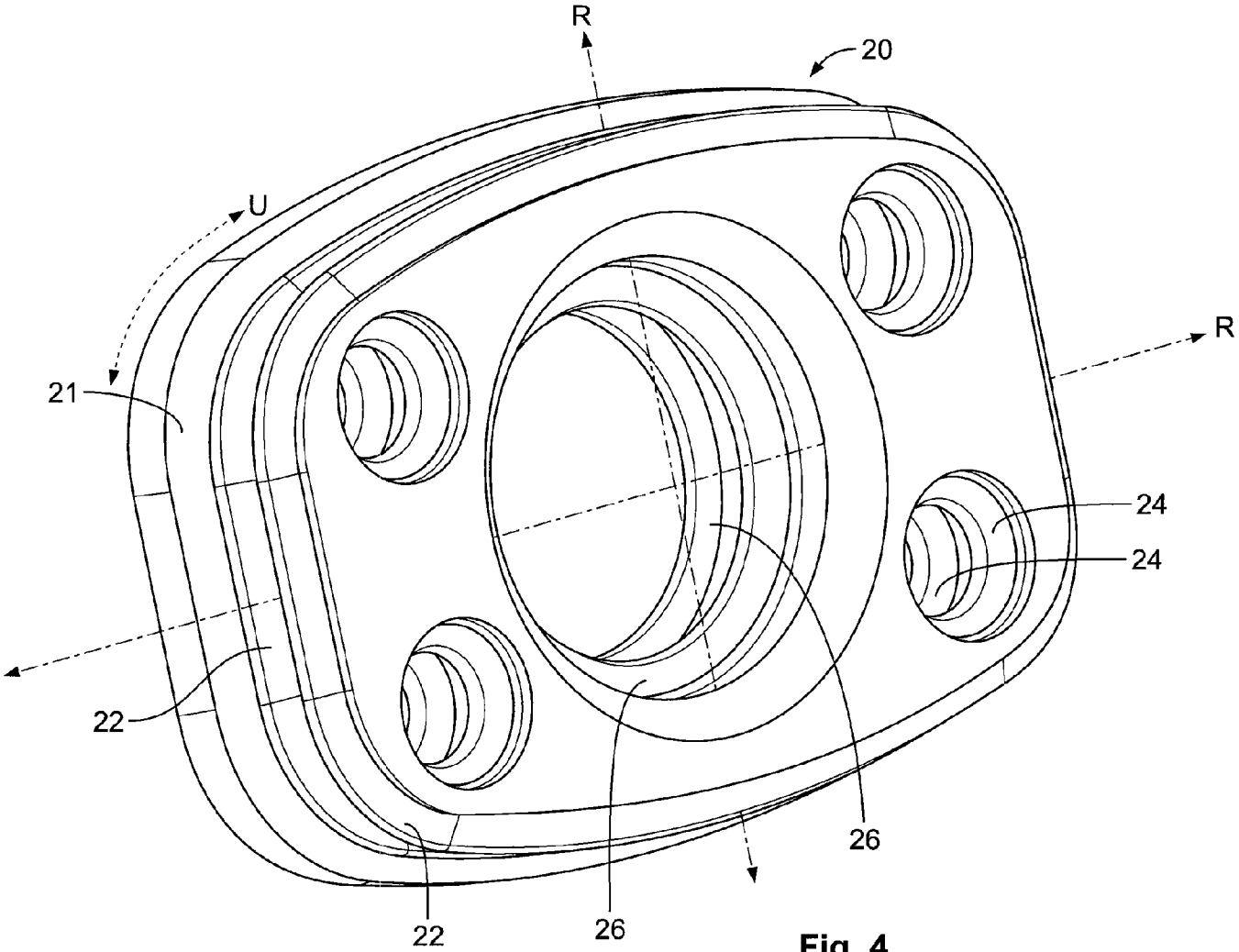
FIG. 4 is a perspective view of a seal according to the invention.

The seal 20 shown in FIG. 4 includes a plurality of, in particular three, sealing devices 22, 24, 26 which are different with respect to their functions. A respective sealing device 22, 24, 26 may be constructed as at least one sealing rib which extends along an outer side of the seal 20 (for instance, see sealing device 22 in FIG. 4) or along an inner side of the seal 20 (for instance, see sealing device 24, 26 in FIG. 4). However, it is also possible to use two, three or four sealing ribs on/in the respective sealing device 22, 24, 26 of the seal 20. For correct positioning and optionally also seating of the seal 20 in the outer housing 10 and for abutment of the mating connector housing 50, the seal 20 includes a collar 21 that extends away from the seal 20. In the shown embodiment, the collar 21 extends completely around the seal 20.

The first sealing device 22 (see FIG. 4) serves to seal the common contact region 3 between the connector 1 and the mating connector 5, the connector 1 sealing with respect to the mating connector 5. The second sealing device 24 seals the secure connection of the inner housing 30 to the outer housing 10 with respect to the contact region 3. The third sealing device 26 serves to seal a line or a cable (not illustrated in the drawings) with respect to the contact region 3. In this instance, the first sealing device 22 is provided so as to extend at the outer side on the seal 20 in a peripheral direction U, whereas the sealing devices 24, 26 are arranged as through-recesses inside the seal 20. The sealing devices 22, 24, 26 and the collar 21 may be constructed materially in one piece with each other, that is to say, integrally, as a seal 20.

The seal 20 is positioned deep inside. along a rear of the outer housing 10. In this instance, the seal 20 is in direct abutment (not illustrated in the drawings) or indirect abutment (see FIGS. 1 and 3) with the inner shoulder 120 of the outer housing 10, the collar 21 positions the seal 20 in the outer housing 10 and may be secured in a clamped position. That is to say, an outer dimension of the collar 21 is slightly greater than a complementary inner dimension of the outer housing 10. The first sealing device 22 adjoins the collar 21 in the seal 20 in the insertion direction S at the front.

In this instance, the first sealing device 22 is constructed in such a manner that, between it and an inner side 100 of the outer housing 10, a gap 110 is provided, which extends in a peripheral direction U between the seal 20 and the outer housing 10. When the connector 1 is arranged with the mating connector 5, a free end portion 51 of the mating connector housing 50 can positioned into this gap 110. In this instance, the sealing device 22 is in sealing abutment at the inner side with the end portion 51 of the mating connector housing 50. An outer side of the end portion 51 and also of the mating connector housing 50 is located inside the outer housing 10 and can abut the inner side 100 thereof.

Furthermore, the seal 20 provides a secure connection between the inner housing 30 and the outer housing 10. In the shown embodiments of the invention, this secure connection is achieved by means of engagement of a catch device 14. In the shown embodiment, the catch device 14, such as, for example, a catch projection, a catch lance, a catch plate or a catch hook, extends from the outer housing 10 and further extends through the seal 20 and into the inner housing 30. The inner housing 30 includes a catch recess that complements the catch device 14 of the outer housing 10 (not illustrated in the drawings) on/in which the catch device 14 of the outer housing 10 can be engaged or is engaged. Of course, this may be constructed in a kinematically inverted manner.

According to the invention, the seal 20 is constructed in such a manner that the second sealing device 24 is in sealing abutment with a central region of the relevant catch device 14, of which two or four may be provided. The seal 20 may be resiliently deformable in so that, by means of the seal 20, a tolerance for the engagement and consequently the mutual securing of the outer housing 10 with the inner housing 30 can be provided. Furthermore, the free end of the mating connector housing 50 abuts a radial portion of the collar 21 of the seal 20 and thereby presses the entire seal 20 in the direction of the inner shoulder 120 of the outer housing 10. The collar 21 may also be resiliently deformable so that, using the collar 21, a tolerance is produced for the insertion of the connector 1 with the mating connector 5.

The third sealing device 26 of the seal 20 may be arranged centrally in the seal 20 and serves to provide sealing with respect to the line, the sealing device 26 abutting the line in a sealing manner. In this instance, according to the invention, with multi-wire lines, sealing is provided directly on a covering of the line (i.e. insulation), individual seals for the wires of the line being able to be dispensed with, but being able to be used. According to the invention, the seal 20 is constructed in a plate-like or plug-like manner, the sealing devices 22, 24, 26 all substantially being arranged in a plane or the axes thereof being parallel with each other. In this instance, particularly the sealing ribs of the sealing devices 22, 24, 26 are located in mutually parallel planes (see FIG. 4).

As shown in FIGS. 2 and 3, a fraction relief member 40 for the line is provided in a region of the seal 20. In this instance, a mounting section 42 of the traction relief member 40 which is constructed as an in particular circular mounting flange that extends into a region between the seal 20 and the inner shoulder 120 of the outer housing 10. That is to say, the seal 20 which is provided in the outer housing 10 is in abutment with the traction relief member 40 at the inner side of the outer housing 10. This retention is reinforced during of connector 1 and the mating connector 5 since, in this instance, the free end of the mating connector 5 presses on the collar 21 and this presses the mounting section 42 of the traction relief member 40 onto the inner shoulder 120.

The traction relief member 40 includes plates 44 which may be constructed as resilient plates 44 that extend into a guide portion 140 of the outer housing 10 for the line. The guide portion 140 is constructed in such a manner that it moves the plates 44 towards each other when the traction relief member 40 is mounted in the outer housing 10. The plates 44 clamp the line between them. For a better clamping effect, the plates 44 may have radially inner projections or hooks, which engage on the covering of the line or engage or extend therein.

Furthermore, in the shown embodiment, the connector 1 includes a lever 12 which, by means of a suitable mechanical system (not illustrated in the drawings), facilitates fitting of the connector 1 onto the mating connector 5. During connection between the connector 1 with the mating connector 5, the inner housing 30 and the contact housing 52 of the mating connector 5 engage one inside the other (see FIG. 1), corresponding contact devices contacting each other in an electrical, optical and/or electro-optical manner. In the shown embodiments, the connector 1 according to the invention has no electromagnetic shielding. However, one skilled in the art should appreciate that it is possible to provide the connector 1 with such shielding.

According to the invention, the seal 20 provides sealing for both the line and the mating connector 5 and the connector 1. Furthermore, the catch devices 14 which extend through the seal 20 are also sealed. The connector 1, the traction relief member 40, the seal 20 and the inner housing 30 are joined in this sequence along the longitudinal direction L. Owing to the engagement of the catch devices 14 of the cap 1 with the contact housing 30, these components are securely connected to each other, and the seal 20 provides tolerance there between. Furthermore, the traction relief member 40 and consequently the line is clamped.

The connector 1 according to the invention may be assembled as follows. Firstly, the outer housing 10, the traction relief member 40 and the seal 20 are pushed onto the line in this sequence. Afterwards, the line is produced and the (electrical) contact devices which are provided thereon are inserted into the inner housing 30 and preferably engaged at that location. The seal 20 and the traction relief member 40 are subsequently pushed on the line towards the inner housing 30. Afterwards, the outer housing 10 is pushed over the components traction relief member 40, seal 20 and inner housing 30, and securely connected to the inner housing 30. In this instance, the catch devices 14 engage with corresponding undercuts in the inner housing 30.

Although several embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A connector comprising:

an outer housing an inner housing;

a seal positioned between the outer housing and the inner housing, the seal having a first sealing device with a sealing rib extending from an outer side of the seal, and a second sealing device with a catch receiving passageway extending through the seal and an internal sealing rib extending from the seal into the catch receiving passageway; and a mating connector receiving gap positioned between an inner side of the outer housing and the first sealing device.

2. The connector according to claim 1, wherein the first sealing device partially extends around the outer side of the seal.

3. The connector according to claim 1, wherein the outer housing includes a catch device extending through the catch receiving passageway and engaging a catch recess of the inner housing.

4. The connector according to claim 3, wherein the catch device is a projection.

5. The connector according to claim 1, wherein the seal further includes a third sealing device having a cable receiving passageway extending through the seal and a protruding sealing rib extending from the seal into the cable receiving passageway.

6. The connector according to claim 1, wherein the seal includes a collar extending radially around the seal.

7. The connector according to claim 6, wherein the collar partially extends around the seal.

8. The connector according to claim 1, wherein the seal provides a secure sealed connection between the outer housing and the inner housing along a contact region of the connector.

9. A connector comprising:

an outer housing;

an inner housing;

a seal having a first sealing device, the seal being positioned between the outer housing and the inner housing such that a mating connector receiving gap is positioned between an inner side of the outer housing and the first sealing device; and a cable traction relief member disposed between the outer housing and the seal.

10. The connector according to claim 9, wherein the cable traction relief member includes a mounting section having a mounting flange extending into a region between the seal and an inner shoulder of the outer housing.

11. The connector according to claim 10, wherein the cable traction relief member includes a plurality of plates that extend into a guide portion of the outer housing and resiliently bias each other when the cable traction relief member is positioned in the outer housing.

12. The connector according to claim 11, wherein the plurality of plates include inner projections.

* * * * *